US010145341B2

(12) United States Patent
Kim et al.

(10) Patent No.: US 10,145,341 B2
(45) Date of Patent: Dec. 4, 2018

(54) STRAINER AND FUEL PUMP MODULE HAVING THE SAME

(71) Applicant: COAVIS, Yeongi-gun (KR)

(72) Inventors: Jeong Sik Kim, Daejeon (KR); Woo Keun Lee, Daejeon (KR); Du Hyun Kim, Miryang-si (KR); Eun Ju Lee, Sejong-si (KR)

(73) Assignee: COAVIS, Yeongi-Gun (KR)

( * ) Notice: Subject to any disclaimer, the term of this patent is extended or adjusted under 35 U.S.C. 154(b) by 762 days.

(21) Appl. No.: 14/283,553

(22) Filed: May 21, 2014

(65) Prior Publication Data

US 2014/0345719 A1 Nov. 27, 2014

(30) Foreign Application Priority Data

May 23, 2013 (KR) ..... 10-2013-0058095

(51) Int. Cl.
*F02M 37/14* (2006.01)
*F02M 37/22* (2006.01)

(52) U.S. Cl.
CPC ..... *F02M 37/14* (2013.01); *F02M 2037/228* (2013.01); *Y10T 137/794* (2015.04)

(58) Field of Classification Search
None
See application file for complete search history.

(56) References Cited

U.S. PATENT DOCUMENTS 796,910 A * 8/1905 Hernan ..... B01D 35/027 210/172.2
1,058,133 A * 4/1913 Yourtree ..... B01D 36/001 210/313
1,394,011 A * 10/1921 Hills ..... B01D 35/02 210/172.4
1,568,796 A * 1/1926 Breer ..... F04B 53/1037 184/6.24
1,677,118 A * 7/1928 Ford ..... B01D 29/23 210/457
1,773,134 A * 8/1930 Fisher ..... F04B 53/1037 137/544
2,253,509 A * 8/1941 Dort ..... B60K 15/00 210/148
3,023,905 A * 3/1962 McDougal ..... B01D 35/027 210/172.4
3,294,025 A * 12/1966 Niemeyer ..... F04D 29/606 210/416.4
3,314,544 A * 4/1967 Rosaen ..... B01D 35/0273 137/140
4,851,118 A * 7/1989 Kurihara ..... B01D 29/15 210/315
4,966,522 A * 10/1990 Koyama ..... B01D 35/027 210/172.4

(Continued)

FOREIGN PATENT DOCUMENTS

KR 2019890010861 7/1989

*Primary Examiner* — Robert J Popovics
(74) *Attorney, Agent, or Firm* — Cantor Colburn LLP

(57) ABSTRACT

Provided are a strainer and a fuel pump module having the same, and more particularly, a strainer capable of preventing filter paper from stopping since the filter paper contacts each other at a portion at which the strainer is folded, in the strainer connected to an inlet of a fuel pump or a fuel pump module to filter fuel sucked thereinto, and a fuel pump module having the same.

5 Claims, 8 Drawing Sheets

(56) References Cited

U.S. PATENT DOCUMENTS 5,120,434 A * 6/1992 Yoshida ..... B01D 29/15 210/172.4
5,312,545 A * 5/1994 Starin ..... B01D 35/027 210/172.6
5,547,568 A * 8/1996 Sasaki ..... B01D 29/15 210/172.4
5,584,988 A * 12/1996 Hashimoto ..... B01D 29/15 210/136
5,607,578 A * 3/1997 Ohkouchi ..... B01D 35/027 210/172.4
5,647,329 A * 7/1997 Bucci ..... B01D 35/0273 123/509
5,776,341 A * 7/1998 Barnard ..... B01D 29/114 210/306
5,795,468 A * 8/1998 Reising ..... B01D 29/15 210/172.4
7,134,568 B2 * 11/2006 Moriyama ..... B60K 15/077 220/563
7,429,322 B2 * 9/2008 Fujita ..... B01D 17/00 210/172.4
7,901,572 B2 * 3/2011 Sato ..... B01D 35/0273 210/172.4
7,964,096 B2 * 6/2011 Kimisawa ..... F02M 37/025 123/509
8,029,667 B2 * 10/2011 Santinon ..... B60K 15/04 210/172.6
8,038,877 B2 * 10/2011 Stausberg ..... B01D 29/52 184/6.24
8,137,546 B2 * 3/2012 Ogose ..... B01D 35/0273 210/172.4
8,173,013 B2 * 5/2012 Sato ..... B01D 35/0273 210/172.4
8,372,278 B1 * 2/2013 Nguyen ..... B01D 35/0273 123/196 A
8,715,497 B2 * 5/2014 Schnipke ..... B01D 35/0273 210/172.2
9,441,586 B2 * 9/2016 Akagi ..... F02M 37/103
9,470,193 B2 * 10/2016 Ries ..... F02M 37/22
9,486,725 B2 * 11/2016 Ries ..... B01D 35/0276
9,816,470 B2 * 11/2017 Nishio ..... F02M 37/10
10,024,283 B2 * 7/2018 Ishitoya ..... B01D 35/0273
2003/0080046 A1 * 5/2003 Ito ..... B01D 29/111 210/416.4
2003/0111060 A1 * 6/2003 Ito ..... B01D 35/027 123/509
2003/0132156 A1 * 7/2003 Rickle ..... B01D 35/0273 210/416.4
2004/0007520 A1 * 1/2004 Rosendahl ..... F01M 11/0004 210/435
2004/0020839 A1 * 2/2004 Kato ..... B01D 35/027 210/232
2004/0045884 A1 * 3/2004 Roth ..... B01D 35/0273 210/184
2004/0129626 A1 * 7/2004 Fischer ..... B01D 35/0273 210/416.4
2004/0140257 A1 * 7/2004 Dockery ..... B01D 35/0273 210/416.4
2004/0144705 A1 * 7/2004 Yamada ..... B01D 35/0273 210/172.4
2004/0159602 A1 * 8/2004 Brower ..... B01D 35/027 210/295
2004/0222143 A1 * 11/2004 Kojima ..... B01D 35/0273 210/416.4
2004/0251194 A1 * 12/2004 Brzozowski ..... B01D 35/0273 210/416.4
2005/0006300 A1 * 1/2005 Sato ..... B01D 35/0273 210/416.4
2005/0023201 A1 * 2/2005 Sato ..... B01D 35/0273 210/172.4
2005/0029173 A1 * 2/2005 Kimisawa ..... B01D 29/15 210/136
2005/0029180 A1 * 2/2005 Kimisawa ..... B01D 29/15 210/172.4
2005/0087178 A1 * 4/2005 Milton ..... F02M 37/025 123/509
2005/0274361 A1 * 12/2005 Ikeya ..... B01D 35/027 123/457
2006/0254974 A1 * 11/2006 Khalil ..... B01D 35/0273 210/420
2006/0266693 A1 * 11/2006 Yoshida ..... B01D 29/56 210/335
2006/0266701 A1 * 11/2006 Dickerson ..... B01D 39/1623 210/503
2007/0095733 A1 * 5/2007 Pizzo ..... B01D 35/0273 210/172.4
2007/0181102 A1 * 8/2007 Hazama ..... B01D 35/027 123/514
2007/0199884 A1 * 8/2007 Nakagawa ..... B01D 35/0273 210/416.4
2007/0215122 A1 * 9/2007 Nakagawa ..... B01D 35/027 123/509
2007/0246420 A1 * 10/2007 Sato ..... B01D 35/0273 210/416.4
2008/0185331 A1 * 8/2008 Sato ..... B01D 35/0273 210/435
2008/0245724 A1 * 10/2008 Oku ..... F02M 37/106 210/416.4
2008/0290013 A1 * 11/2008 Stausberg ..... B01D 29/52 210/167.04
2009/0039011 A1 * 2/2009 Sato ..... B01D 35/0273 210/491
2009/0050551 A1 * 2/2009 Kimisawa ..... F02M 37/025 210/172.4
2009/0120858 A1 * 5/2009 Kojima ..... B01D 35/0273 210/167.08
2009/0139922 A1 * 6/2009 Poskie ..... B01D 35/0273 210/167.08
2009/0301954 A1 * 12/2009 Beer ..... F01M 11/0004 210/167.08
2009/0321347 A1 * 12/2009 Ogose ..... B01D 35/0273 210/452
2010/0038296 A1 * 2/2010 Beer ..... F01M 11/0004 210/167.03
2010/0072120 A1 * 3/2010 Sato ..... B01D 35/0273 210/172.4
2010/0206793 A1 * 8/2010 Oku ..... B01D 29/114 210/172.4
2010/0206802 A1 * 8/2010 Sato ..... B01D 35/0273 210/490
2010/0294464 A1 * 11/2010 Graber ..... B01D 29/114 165/104.19
2011/0036763 A1 * 2/2011 Santinon ..... B60K 15/04 210/232
2011/0132825 A1 * 6/2011 Nishio ..... F02M 37/10 210/172.4
2011/0139278 A1 * 6/2011 Kawajiri ..... F02M 37/025 137/565.01
2011/0155658 A1 * 6/2011 Graber ..... B01D 39/1623 210/243
2011/0180469 A1 * 7/2011 Sato ..... B01D 35/0273 210/172.4
2011/0192774 A1 * 8/2011 Ogose ..... B01D 35/0273 210/137
2011/0192786 A1 * 8/2011 Nagai ..... F02M 37/22 210/443
2012/0240901 A1 * 9/2012 Yamada ..... B01D 35/027 123/509
2014/0096849 A1 * 4/2014 Akagi ..... F02M 37/103 137/545
2014/0345719 A1 * 11/2014 Kim ..... F02M 37/14 137/544
2015/0060349 A1 * 3/2015 Ishitoya ..... B01D 35/0273 210/416.4
2018/0209386 A1 * 7/2018 Hayashi ..... F02M 37/10

* cited by examiner

STRAINER AND FUEL PUMP MODULE HAVING THE SAME

CROSS-REFERENCE TO RELATED APPLICATIONS

This application claims priority under 35 U.S.C. § 119 to Korean Patent Application No. 10-2013-0058095, filed on May 23, 2013, in the Korean Intellectual Property Office, the disclosure of which is incorporated herein by reference in its entirety.

TECHNICAL FIELD

The present invention relates to a strainer and a fuel pump module having the same, and more particularly, to a strainer capable of preventing a filter paper from stopping since the filter paper contacts each other at a portion at which the strainer is folded, in the strainer connected to an inlet of a fuel pump or a fuel pump module to filter fuel sucked thereinto, and a fuel pump module having the same.

BACKGROUND

An apparatus such as a vehicle which is driven by being supplied with liquid fuel such as a gasoline engine and a diesel engine is provided with a fuel tank and the fuel tank is provided with a fuel pump module, in which the fuel pump module is configured to be connected to the engine via a fuel supply line to supply fuel stored inside the fuel tank to the engine. In this case, a fuel inlet of the fuel pump module is provided with a strainer which primarily filters the fuel inside the fuel tank to be sucked into a fuel pump which is disposed inside the fuel pump module.

As illustrated in FIGS. 1 and 2, a strainer 4 is disposed at a fuel inlet 3*a* of a fuel pump 3 which is disposed inside a fuel tank 1 and in the strainer 4, to prevent a phenomenon that the filtering is not made since the filter paper 4*b* contacts each other at the time of the suction of fuel, a rib 4*c* which is provided with a plurality of protruding parts is inserted into or combined with the filter paper 4*b*.

However, the strainer is formed to be folded as occasion demands, and an upper filter paper and a lower filter paper contacts each other at the folded portion and thus the fuel may not be filtered or the filtered foreign materials are deposited at the folded portion of the filter paper and thus the filter paper may stop. Further, to design the strainer so that the strainer is folded at a desired portion, the rib needs to be added with the plurality of protrusions and thus the design of the strainer may be complicated.

As the related art, there is Korean Utility Model Laid-Open Publication No. 20-1989-010861 entitled "in tank type fuel pump".

RELATED ART DOCUMENT

Patent Document (Patent Document 1) KR 20-1989-010861 U (Jul. 11, 1989)

SUMMARY

An exemplary embodiment of the present invention is directed to providing a strainer capable of preventing an upper filter paper and a lower filter paper from contacting each other at a folded portion of the strainer to prevent a deposition of filtered materials and a stoppage of the filter paper at the folded portion and a fuel pump module having the same.

In one general aspect, there is provided a strainer including: a filter paper 100 filtering fuel and having a space 130 disposed therein; an upper rib 210 combined with an outer upper portion of the filter paper 100; a plurality of protruding parts 300 protruding down from the upper rib 210 to be disposed inside the filter paper 100; and a communicating pipe 400 combined with the filter paper 100 to communicate with the space 130 of the filter paper 100, wherein the filter paper 100 and the upper rib 210 are partially folded up longitudinally, and the upper and lower portions of the filter paper 100 are formed not to contact each other at the folded portion.

The strainer may further include: a lower rib 220 combined with the outer lower portion of the filter paper 100; and the plurality of protruding parts 300 protruding up from the lower rib 220 to be disposed inside the filter paper 100; wherein the filter paper 100, the upper rib 210, and the lower rib 220 are partially folded longitudinally and thus the upper and lower portions of the filter paper 100 are formed not to contact each other at the folded portion.

The upper rib 210 and the lower rib 220 may be disposed in parallel to be spaced apart from each other in the width direction of the filter paper 100 and the upper rib 210 and the lower rib 220 may be alternately disposed.

Widths W of the protruding parts may be each formed differently and distances D between the protruding parts may be each formed differently, and the width W of the protruding part and the distance D between the protruding parts may be more narrowly formed at the portion at which the filter paper is folded than at the portion at which the filter paper is not folded.

In another general aspect, there is provided a strainer 1000 including: a filter paper 100 filtering fuel and having a space 130 disposed therein; an inner rib 230 disposed inside the filter paper 100; a plurality of protruding parts 300 protruding up and down from the inner rib 230 to be disposed inside the filter paper 100; and a communicating pipe 400 combined with the filter paper 100 to communicate with the space 130 of the filter paper 100, wherein the filter paper 100 and the inner rib 230 are partially folded up longitudinally, and the upper and lower portions of the filter paper 100 are formed not to contact each other at the folded portion.

Widths W of the protruding parts may be each formed differently and distances D between the protruding parts may be each formed differently, and the width W of the protruding part and the distance D between the protruding parts may be more narrowly formed at the portion at which the filter paper is folded than at the portion at which the filter paper is not folded.

In still another general aspect, there is provided a fuel pump module 2000 including: the strainer 1000 as described above, wherein the strainer 1000 is disposed inside a reservoir body 1200 in a partially folded state and a communicating pipe 400 of the strainer 1000 is connected to an inlet 1110 of the fuel pump 1100 which is disposed inside the reservoir body 1200.

DETAILED DESCRIPTION OF EMBODIMENTS

Hereinafter, a strainer and a fuel pump module having the same according to exemplary embodiments of the present invention will be described in detail with reference to the accompanying drawings.

Figure 1:
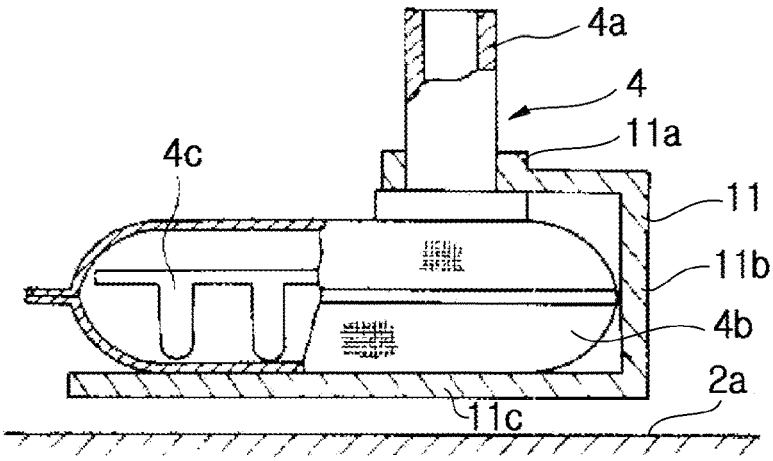
FIG. 1 Prior Art
FIGS. 1 and 2 are cross-sectional views illustrating a strainer and a fuel pump module according to the related art.
Figure 2:
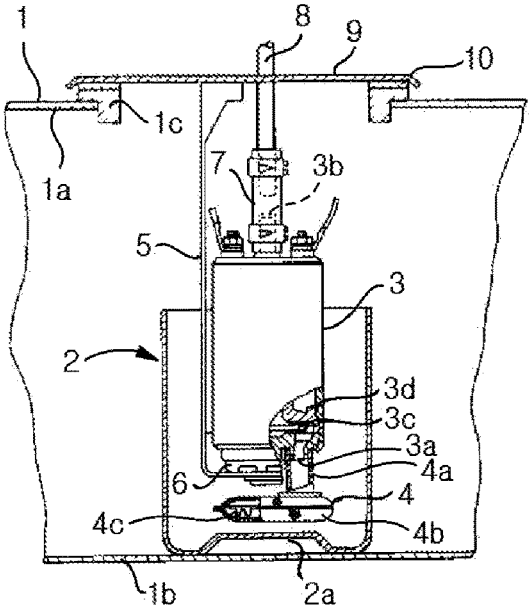
FIG. 2 Prior Art
Figure 3:
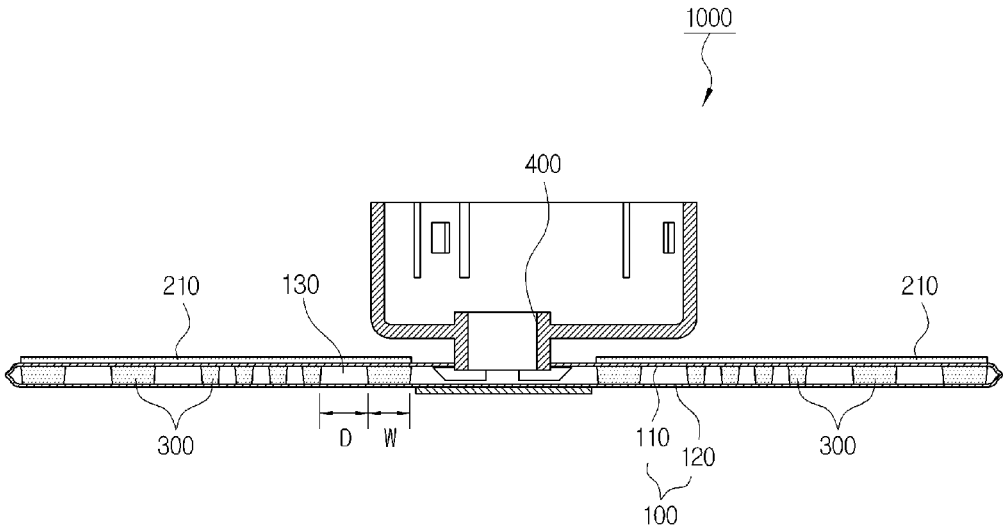
FIG. 3 is a cross-sectional view illustrating a strainer according to a first exemplary embodiment of the present invention.
Figure 4:
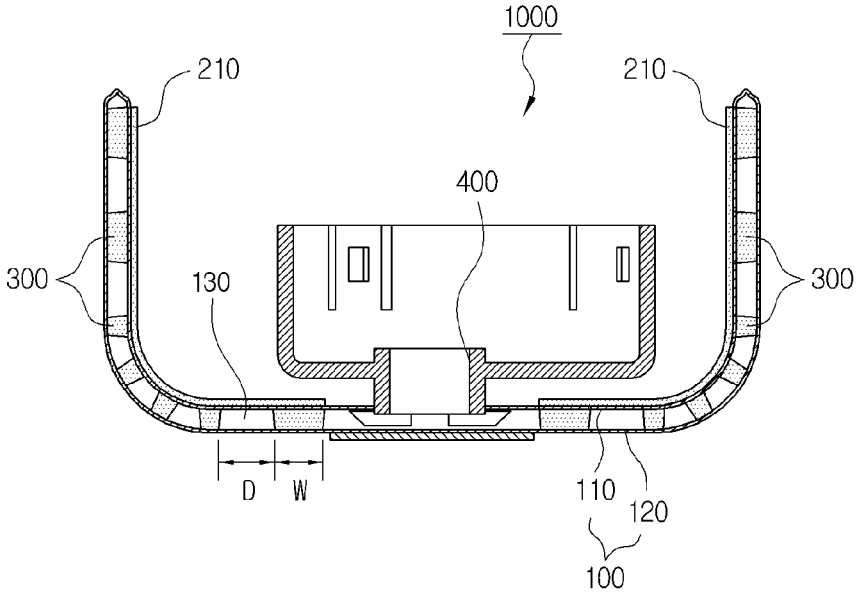
FIGS. 4 and 5 are a cross-sectional view and a perspective view illustrating a state in which the strainer of FIG. 3 is folded.
Figure 5:
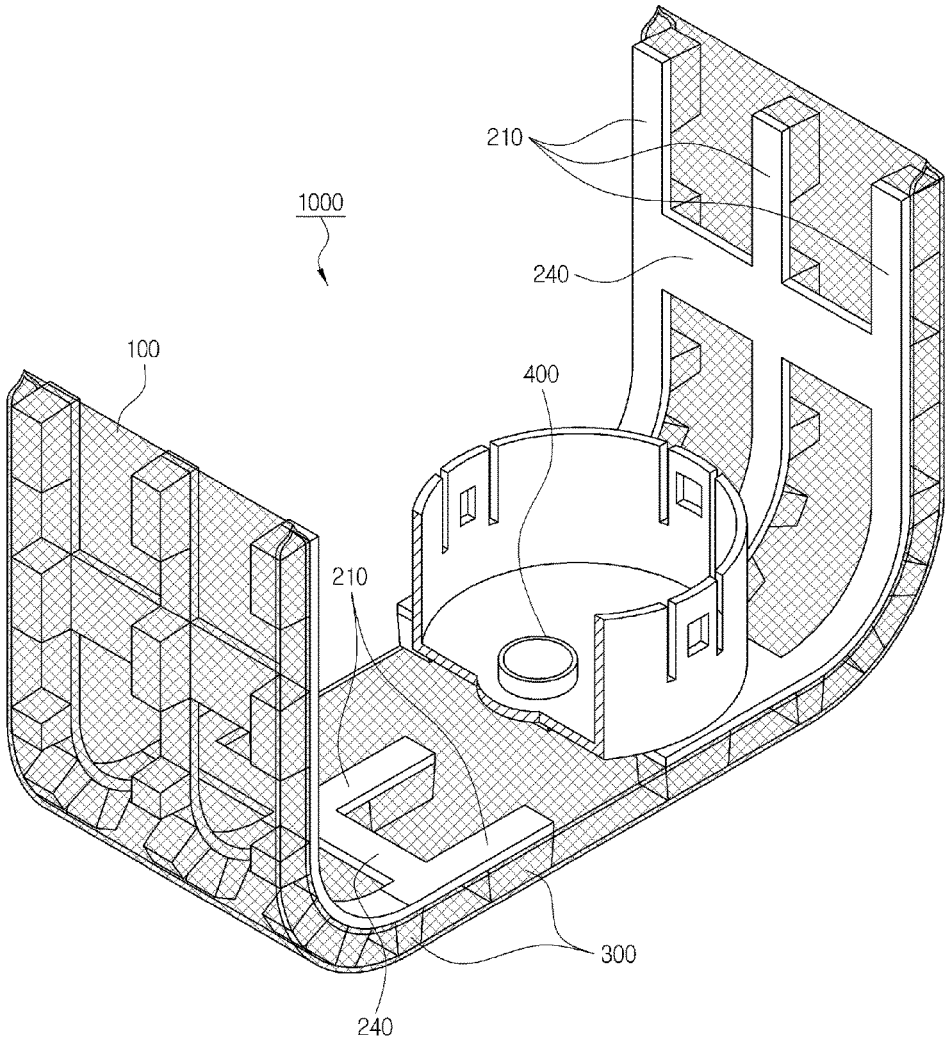

First, as illustrated in FIGS. 3 to 5, a strainer 1000 according to a first exemplary embodiment of the present invention includes a filter paper 100 filtering fuel. The filter paper 100 is formed of an upper filter paper 110 and a lower filter paper 120 and having a space 130 defined between the upper and lower filter paper 120. An upper rib 210 is disposed on the upper surface portion of the upper filter paper. A plurality of protruding parts 300 protrudes down from the upper rib 210 to be disposed inside the space 130 so as to maintain the space 130. A communicating pipe 400 is installed in the upper filter paper 110 to communicate with the space 130 of the filter paper 100. As shown in FIG. 5, the filter paper 100 and the upper rib 210 are partially folded. However, an upper filter paper 110 and the lower filter paper 120 are not contacted with each other by means of the protruding part 300 of the upper rib 210, even at the folded portion of the strainer 1000.

The filter paper 100 filters fuel and may be formed in a thin mesh form. Further, as described above, the filter paper 100 is formed of the upper filter paper 110 and the lower filter paper 120 spaced apart from each other so as to have the space 130 in-between. Edges of the upper filter paper 110 and the lower filter paper 120 are coupled with each other along the edges by a welding method, and the like.

The upper rib 210 is installed in an upper surface of the upper filter paper 110, which is the outer upper portion of the filter paper 100. In this configuration, the upper rib 210 is formed in a long bar shape and thus may adhere to the upper surface of the upper filter paper 110. Meanwhile, the upper rib 210 is formed in plural, in which the plurality of upper ribs 210 may be formed in parallel to be spaced apart from each other in a width direction of the strainer 1000. Further, when the upper rib 210 is formed in plural, a connection rib 240 which connects between the neighboring upper ribs 210 may also be formed. Therefore, as illustrated in FIGS. 3 to 5, the upper rib 210 supports the outer upper portion of the filter paper 100 and thus serves to maintain the form of the filter paper 100.

The protruding part 300 protrudes down from the upper rib 210 and is disposed inside the space 130. In this case, the protruding part 300 is formed in plural, in which the plurality of protruding parts 300 are formed along the upper rib 210, being spaced apart from each other. Further, a lower end of the protruding part 300 is extended to the upper surface of the lower filter paper 120 to maintain a distance between the upper filter paper 110 and the lower filter paper 120, i.e., maintain the space 130.

In this case, the upper filter paper 110, the upper rib 210, and the protruding part 300 are made of a plastic resin material. The upper rib 210 and the protruding part 300 are injection molded together, having the upper filter paper 110 disposed therebetween, such that the upper rib 210, the protruding parts 300 and the upper filter paper 110 are formed in an integral form where the upper rib 210 and the protruding part 300 down from the upper rib 210 penetrate through the upper filter paper 110. Therefore, the upper filter paper 110, the upper rib 210, and the protruding part 300 are integrally formed and then the edges of the upper filter paper 110 and the lower filter paper 120 are bonded to each other.

The communicating pipe 400 is disposed in the filter paper 100 so as to fluid-communicate with the space 130. More specifically, the communicating pipe 400 may be connected with the space 130 through the upper filter paper 110. Further, the communicating pipe 400 is also made of a plastic resin material and may be bonded to the upper filter paper 110 by the welding method, and the like to penetrate through the upper filter paper 110. In this case, the lower end of the communicating pipe 400 disposed inside the space 130 of the filter paper 100 is provided with a plurality of plates which radially protrude, are spaced apart from each other along a circumferential direction, and protrude down from the lower end of the communicating pipe 400 and thus the lower end of the communicating pipe 400 does not contact the lower filter paper 120, thereby smoothing the filtering and injection of fuel.

Therefore, the strainer 1000 according to the exemplary embodiment of the present invention is configured to suck the fuel into the space 130 inside the filter paper 100. During the suction of the fuel, the fuel is filtered through the upper filter paper 110 and the lower filter paper 120 and then the filtered fuel flows along the communicating pipe 400.

In this case, the filter paper 100 and the upper rib 210 are partially folded longitudinally, but the upper and lower filter papers 110 of the filter paper 100 are not to contact each other at the folded portion. That is, as illustrated in FIG. 4, in the state in which the filter paper 100 and the upper rib 210 are partially folded up, the protruding parts 300 support the upper filter paper 110 and the lower filter paper 120 of the folded and rounded portion to maintain the distance between the upper filter paper 110 and the lower filter paper 120.

As described above, the strainer according to the exemplary embodiment of the present invention is formed not to contact the upper and lower filter papers at the folded portion even though the strainer is folded. Therefore, it is possible to prevent the deposition of filtered materials and the stoppage of the filter paper at the folded portion. Further, the upper rib 210 is disposed on the upper surface of the upper filter paper 110 which is the outside of the filter paper 100 and thus the protruding parts 300 protrude down from the upper rib 210, such that the upper rib 210 and the filter paper 100 may be easily folded regardless of the distance between the protruding parts 300. The upper rib 210 is fixed with the upper filter paper 110, such that it is possible to prevent the upper filter paper 110 from being folded inwardly (toward the space of the filter paper 100) at the time of the folding, thereby preventing the upper filter paper 110 and the lower filter paper 120 from contacting each other. Further, the upper rib 210 is provided outside the filter paper 100 and therefore a volume of the space 130 inside the filter paper 100 may be increased, thereby reducing a flowing resistance during the filtering of fuel.

Figure 6:
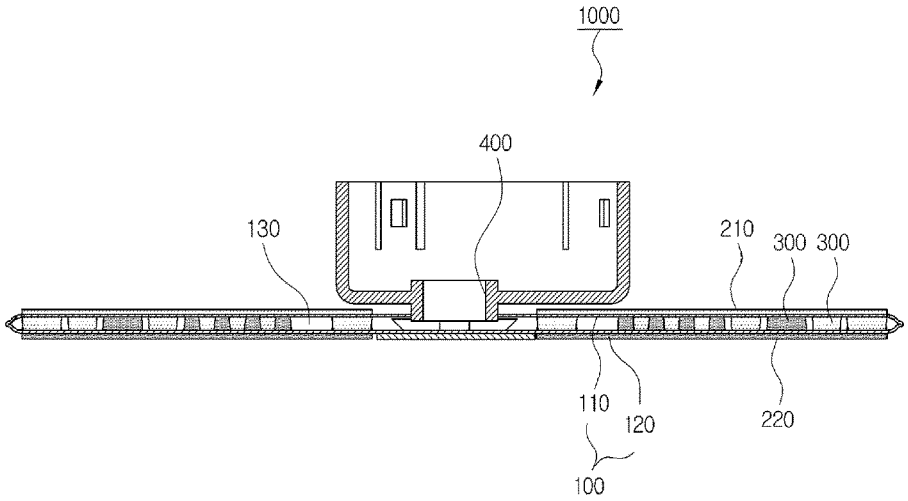
FIG. 6 is a cross-sectional view illustrating a strainer according to a second exemplary embodiment of the present invention.
Figure 7:
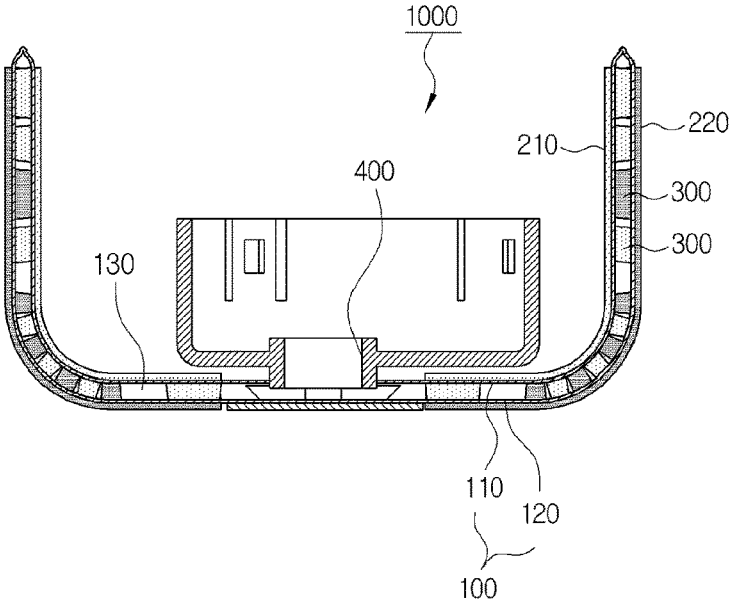
FIGS. 7 and 8 are a cross-sectional view and a perspective view illustrating a state in which the strainer of FIG. 6 is folded.
Figure 8:
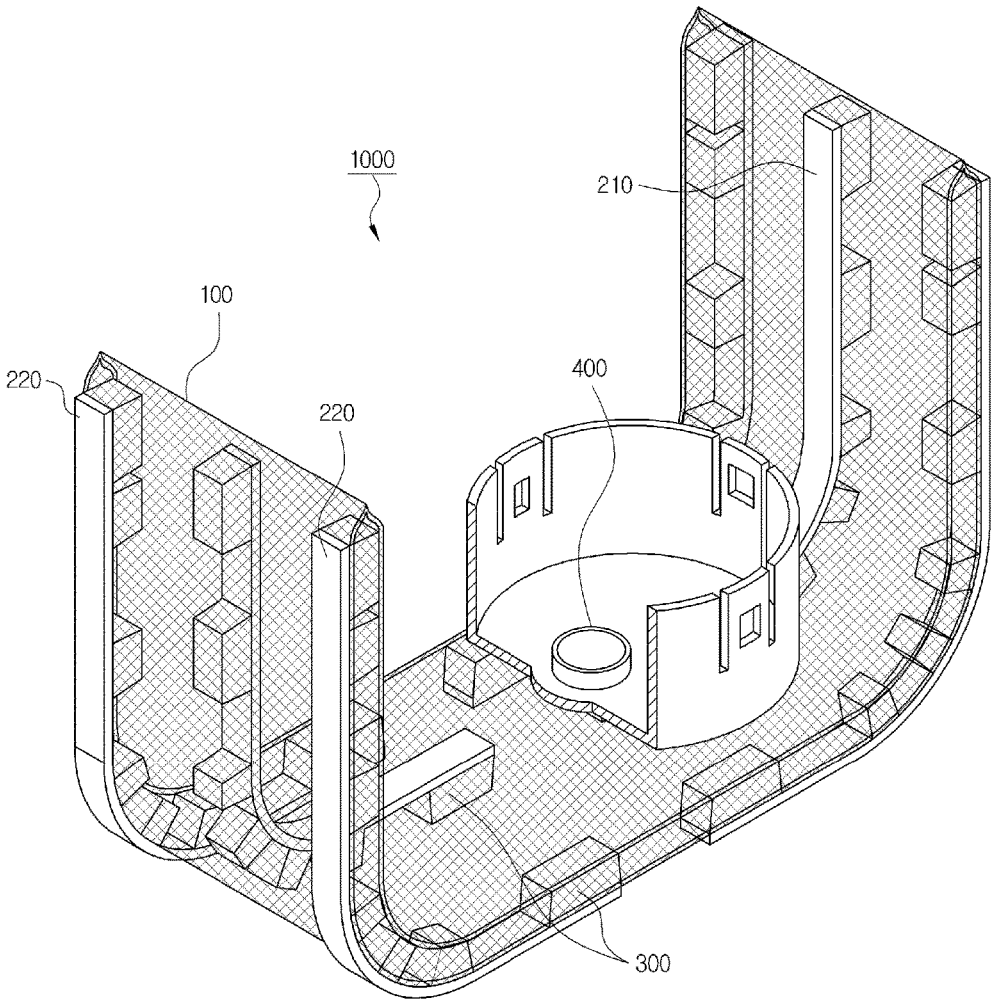

Further, FIGS. 6 to 8 shows a second exemplary embodiment of the present invention. The strainer 1000 according to the second exemplary embodiment of the present invention further includes: a lower rib 220 coupled to the outer bottom portion of the filter paper 100; and the plurality of protruding parts 300 protruding up from the lower rib 220 to be disposed inside the space 130 of the filter paper 100. Similar to the first embodiment, in the second embodiment, the filter paper 100, the upper rib 210, and the lower rib 220 may be partially folded longitudinally and the upper and lower filter papers of the filter paper 100 may be not to contact each other at the folded portion by means of the protruding parts 300 of both the upper rib 210 and the lower rib 220.

As illustrated in FIGS. 6 to 8, in the strainer according to the second exemplary embodiment of the present invention, the lower rib 220 is additionally provided at the lower surface of the lower filter paper 120 and the protruding part 300 protrudes up from the lower rib 220 to be disposed in the space 130 inside of the filter paper 100.

Therefore, even though the strainer is folded, the form of the filter paper 100 is easily maintained by the upper rib 210 and the lower rib 220 which are each provided with the plurality of protruding parts 300 and thus the upper and lower filter papers are not to contact each other at the portion folded by the protruding parts. Therefore, it is possible to prevent the deposition of the filtered materials and the stoppage of the space 130 of the filter paper 100 at the folded portion.

In this case, the upper rib 210 and the lower rib 220 may be in parallel to be spaced apart from each other in the width direction of the filter paper 100 and the upper rib 210 and the lower rib 220 may be alternately disposed, as illustrated in FIG. 8. That is, the upper rib 210 is disposed at a center in the width direction of the upper filter paper 110 and the lower rib 220 is disposed at both sides in the width direction of the lower filter paper 120, such that the upper rib 210 and the lower rib 220 may be formed to be alternately disposed in parallel so as to be spaced apart from each other in the width direction of the filter paper 100.

Therefore, the distance between the upper and lower filter papers at the portion at which the strainer is folded is easily maintained, such that it is possible to prevent the deposition of the filtered materials and the stoppage of the space inside the filter paper at the folded portion.

Further, widths W of the protruding parts 300 may be different from each other and distances D between the protruding parts may be different from each other. Further, the width W of the protruding part 300 and the distance D between the protruding parts 300 may be relatively narrow at the portion at which the filter paper 100 is folded, as shown in FIGS. 7 and 8.

That is, in connection with the plurality of protruding parts 300 protruding down from the upper rib 210, the width W of the protruding part and the distance D between the protruding parts are formed to be narrower at the folded portion than any other portion. Therefore, when the strainer is folded, the lower filter paper 120 is supported by the protruding parts 300 to easily maintain the distance between the upper and lower filter papers. Similarly, in connection with the protruding parts 300 protruding up from the lower rib 220, the width W of the protruding part and the distance D between the protruding parts are formed to be narrower at the portion at which the strainer is folded than any other portion and, thus, when the strainer is folded, the protruding parts 300 are easily support the upper filtering paper 120.

Figure 9:
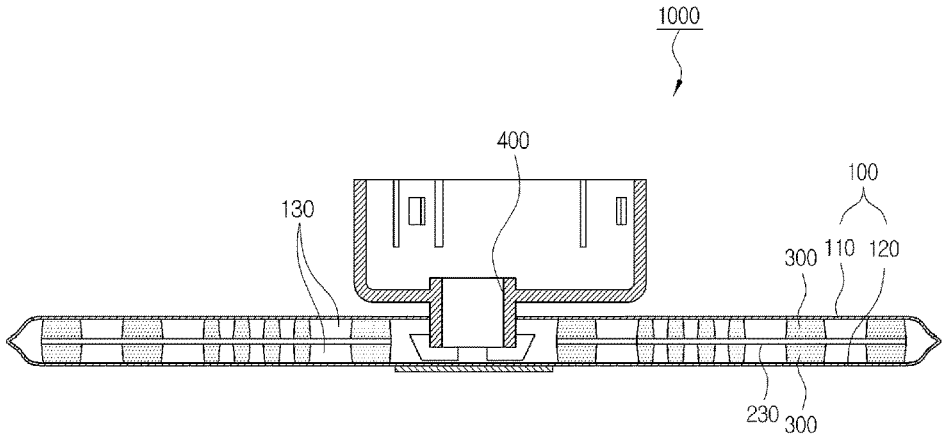
FIG. 9 is a cross-sectional view illustrating a strainer according to a third exemplary embodiment of the present invention.
Figure 10:
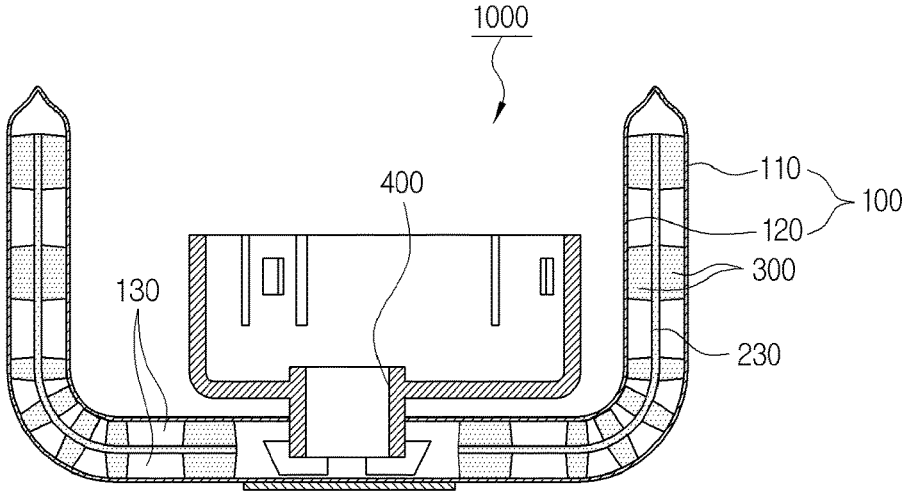
FIG. 10 is a cross-sectional view and a perspective view illustrating a state in which the strainer of FIG. 9 is folded.
Figure 11:
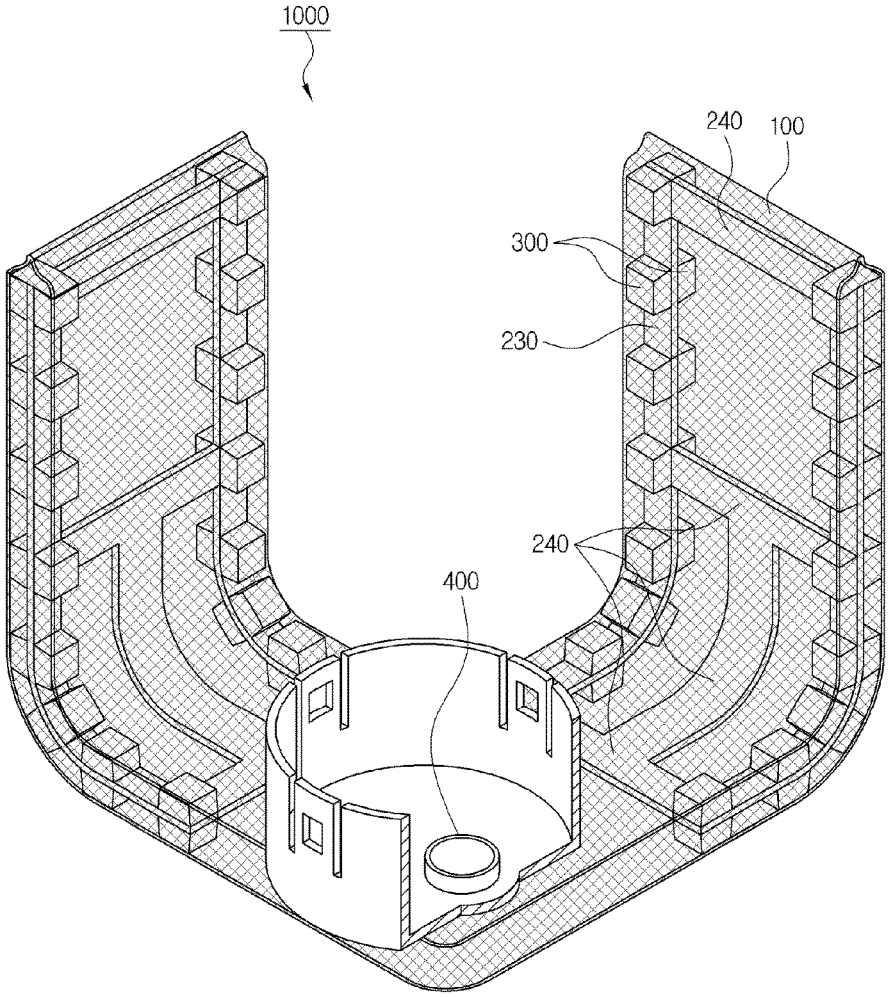
FIG. 11 is a perspective view illustrating an example in which the strainer according to the third exemplary embodiment of the present invention is modified.

Further, FIGS. 9 to 11 illustrate a third embodiment of the present invention. The strainer 1000 according to the third exemplary embodiment of the present invention includes: the filter paper 100 filtering fuel and having the space 130 formed disposed therein; an inner rib 230 disposed inside the space of the filter paper 100; a plurality of protruding parts 300 protruding up and down from the inner rib 230 to be disposed inside the space 130 of the filter paper 100; and the communicating pipe 400 mounted in the filter paper 100 to fluid-communicate with the space 130 of the filter paper 100. The filter paper 100 and the inner rib 230 are partially folded longitudinally and the upper and lower portions of the filter paper 100 are formed not to contact each other at the folded portion by filter paper 110*he* protruding parts 300.

Similar to the first and second embodiment, the filter paper 100 is formed of an upper filter paper 110 and a lower filter paper 120, edges of which are bonded or welded to each other to define the space 130 of the filter paper 100.

As illustrated in FIGS. 9 to 11, the inner rib 230 is disposed inside the space 130 of the filter paper 100, and the upper and lower portions of the inner rib 230 are provided with the plurality of protruding parts 300 in such a manner that the upper filter paper 110 and the lower filter paper 120 are not contacted to each other at the portion where the strainer is folded. In this case, in the state in which the upper and lower portions of the inner rib 230 are integrally provided with the protruding parts 300, the inner rib 230 is inserted into the space 130 of the filter paper 100 and then the edge portions of the upper filter paper 110 and the lower filter paper 120 may be sealed by the welding method, and the like.

Therefore, in the strainer according to the third exemplary embodiment of the present invention, the protruding parts 300 formed on the upper and lower portions of the inner rib 230 support the upper filter paper 110 and the lower filter paper 120, such that the upper filter paper 110 and the lower filter paper 120 may not contact each other to maintain the distance in-between.

Further, as illustrated in FIG. 11, in the strainer according to the third exemplary embodiment of the present invention, the filter paper 100 is formed in an asymmetrical form and thus may also be formed to be partially folded up.

Further, similarly to the first and second embodiments, in the strainer according to the third exemplary embodiment of the present invention, the widths W of the protruding parts may be different from each other and the distances D between the protruding parts may be different from each other. Further, the width W of the protruding part and the distance D between the protruding parts may be relatively narrow at the portion at which the filter paper 100 is folded.

Figure 12:
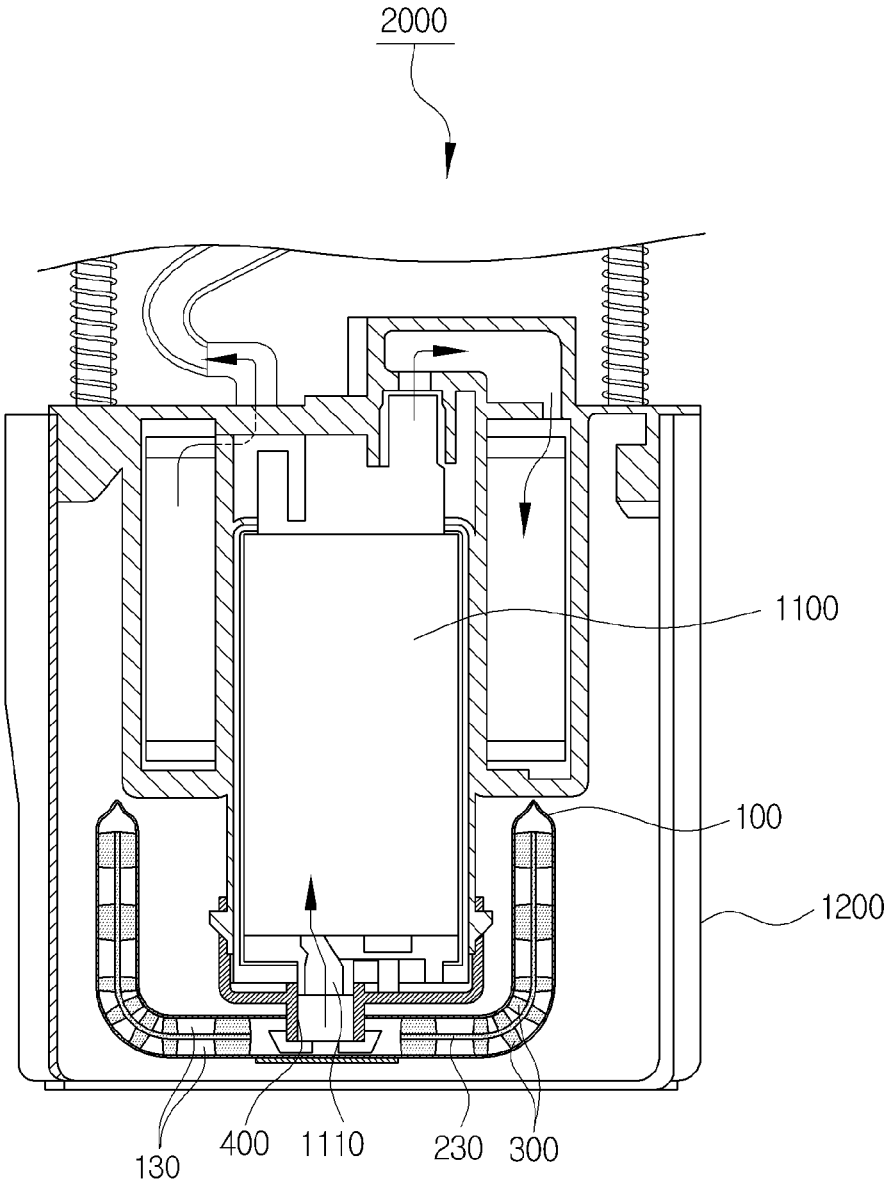
FIG. 12 is a schematic cross-sectional view illustrating a fuel pump module having the strainer according to the exemplary embodiment of the present invention.

Further, FIG. 12 illustrates a fuel pump module 2000 according to an exemplary embodiment of the present invention. The fuel pump module 2000 is configured to include the strainer 1000, in which the strainer 1000 is disposed inside a reservoir body 1200 in the partially folded state and the communicating pipe 400 of the strainer 1000 is configured to be connected to an inlet 1110 of the fuel pump 1100 which is disposed inside the reservoir body 1200.

That is, as illustrated in FIG. 12, the fuel pump module 2000 according to the exemplary embodiment of the present invention is disposed inside the fuel tank and thus the fuel inside the fuel tank is partially filled inside the reservoir body 1200, and the communicating pipe 400 of the strainer

1000 is connected to the inlet 1110 of the fuel pump 1100 so that the fuel in the reservoir body 1200 may be sucked into the fuel pump 1100 through the strainer 1000. Therefore, the fuel pump module 2000 may be configured so that the filtered fuel is sucked into the fuel pump 1100 through the lower portion of the strainer 1000 and both sides of the strainer 1000 which is vertically folded.

As described above, the fuel pump module 2000 according to the exemplary embodiment of the present invention is configured so that the upper and lower filter papers are formed not to contact each other at the portion at which the strainer is folded, and thus it is possible to prevent the deposition of the filtered materials and the stoppage of the filter paper at the folded portion.

According to the strainer and the fuel pump module having the same in accordance with the present invention, even though the strainer is folded, the upper and lower filter papers are formed not to contact each other at the folded portion, thereby preventing the deposition of the filtered materials and the stoppage of the filter paper at the folded portion.

The present invention is not limited to the above-mentioned exemplary embodiments but may be variously applied, and may be variously modified by those skilled in the art to which the present invention pertains without departing from the gist of the present invention claimed in the claims.

What is claimed is:

1. A strainer, comprising:

a filter paper filtering fuel, the filter paper including an upper filter paper and a lower filter paper, edges of which are connected to each other to form a space inside the filter paper;

an upper rib disposed on an outer upper portion of the filter paper, wherein the upper rib is disposed on an upper surface of the upper filter paper;

a lower rib disposed on an outer lower portion of the filter paper, wherein the lower rib is disposed on a bottom surface of the lower filter paper;

a plurality of first protruding parts protruding down from the upper rib and penetrating the upper filter paper, wherein the first protruding parts are disposed inside the space;

a plurality of second protruding parts protruding up from the lower rib and penetrating the lower filter paper, wherein the second protruding parts are disposed inside the space;

a communicating pipe disposed on the filter paper to fluid-communicate with the space of the filter paper in such a way that the fuel inside the space flows through the communicating pipe to outside the strainer, wherein the filter paper, the upper rib and the lower rib are partially folded up longitudinally in a rounded form, and the upper filter paper and the lower filter paper are spaced apart from each other by the first protruding parts and the second protruding parts.

2. The strainer of claim 1, wherein the upper rib and the lower rib are disposed in parallel to be spaced apart from each other in a width direction of the filter paper and the upper rib and the lower rib are alternately disposed in the width direction of the filter paper.

3. The strainer of claim 1, wherein the first protruding parts have a first distance D between neighboring first protruding parts at the folded portion, wherein the first distance D is narrower than that of an unfolded portion.

4. The strainer of claim 1, wherein the second protruding parts have a second distance D between neighboring second protruding parts at the folded portion, wherein the second distance D is narrower than that of an unfolded portion.

5. A fuel pump module, comprising:

the strainer of claim 1, wherein the strainer is disposed inside a reservoir body in a partially folded state and the communicating pipe of the strainer is connected to an inlet of the fuel pump which is disposed inside the reservoir body.

* * * * *